United States Patent [19]

Wood

[11] 4,373,627

[45] Feb. 15, 1983

[54] ARTICLE CARRIER

[75] Inventor: Prentice J. Wood, Hapeville, Ga.

[73] Assignee: The Mead Corporation, Dayton, Ohio

[21] Appl. No.: 150,204

[22] Filed: May 15, 1980

Related U.S. Application Data

[60] Continuation-in-part of Ser. No. 34,429, Apr. 30, 1979, abandoned, which is a division of Ser. No. 893,190, Apr. 3, 1978, abandoned.

[51] Int. Cl.[3] ..... B65D 75/00

[52] U.S. Cl. ..... 206/201; 206/203; 206/459; 40/308

[58] Field of Search ..... 206/201, 202, 203, 459, 206/461, 485, 216; 40/308

[56] References Cited

U.S. PATENT DOCUMENTS

| | | | |
|---|---|---|---|
| 2,599,787 | 6/1952 | Schmidt | 206/202 |
| 2,916,185 | 12/1959 | Skulavik | 206/202 |
| 2,967,641 | 1/1961 | Versack | 206/202 |
| 3,039,651 | 6/1962 | Lang | 206/203 |
| 3,142,407 | 7/1964 | Poupitch | 206/203 |
| 3,178,052 | 4/1965 | Bromley | 206/203 |
| 3,609,893 | 10/1971 | Routzahn et al. | 40/308 |
| 4,113,087 | 8/1978 | Morcom | 206/203 |

*Primary Examiner*—Joseph Man-Fu Moy
*Attorney, Agent, or Firm*—Rodgers & Rodgers

[57] ABSTRACT

An article carrier comprising a frame structure, a plurality of struts depending downwardly from the frame structure to form a plurality of article receiving cells, a bottom element secured to the lower portions of the struts forming each cell, a partition element disposed between and secured to two adjacent struts of at least some of said cells, the midportion of the partition element being yieldable, a plurality of outwardly projecting base straps interconnecting the lower portions of two adjacent struts on each side of the carrier, and a promotional insert panel disposed on each side of said carrier and secured in position by cooperation with the corresponding base straps and the frame structure.

7 Claims, 11 Drawing Figures

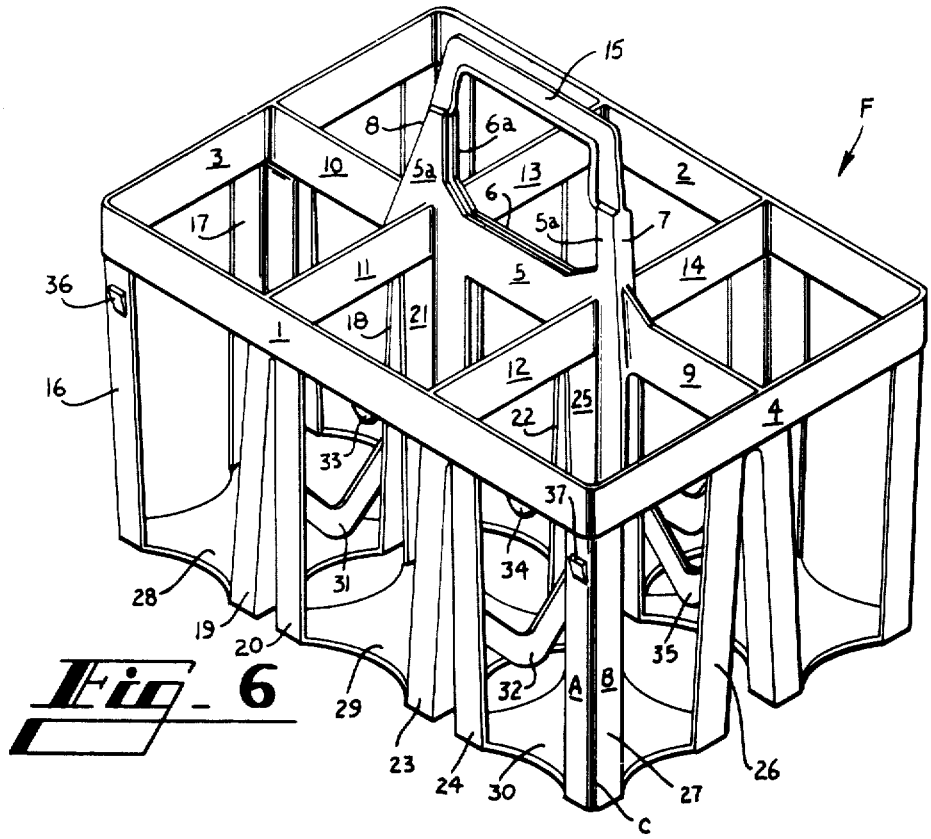
Fig. 6
Fig. 7
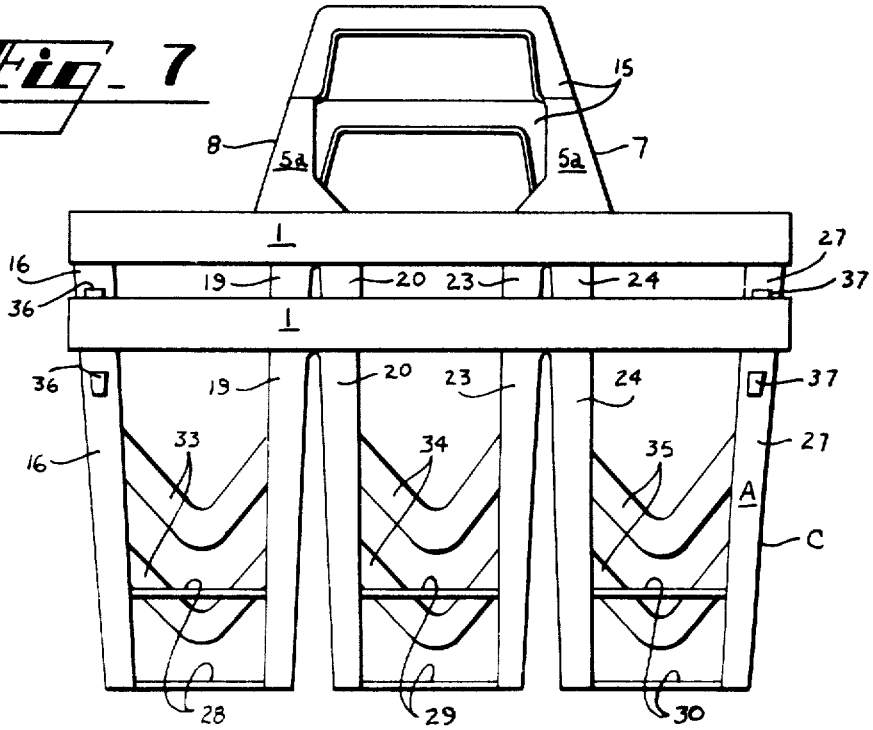

ARTICLE CARRIER

This application is a continuation-in-part of application Ser. No. 34,429 filed Apr. 30, 1979, which is a division of application Ser. No. 893,190 filed Apr. 3, 1978, abandoned.

TECHNICAL FIELD

This invention relates to the packaging of articles in strong reusable carriers which have a promotional capability.

BACKGROUND ART

The current popularity of large primary packages has emphasized the need for strong and reliable article carriers. Several methods of satisfying these requirements have been utilized such as strengthening the material of the conventional paperboard carrier or reducing the quantity of articles packaged in each carrier. As an alternative to either of these methods, a carrier constructed completely of plastic or a combination of plastic and paperboard is extremely strong, durable, and economical and at the same time is capable of providing a means for conveniently advertising the packaged products. One example of such a combination plastic and paperboard carrier is disclosed in U.S. Pat. No. 3,399,804 owned by the assignee of this invention.

DISCLOSURE OF INVENTION

According to one form of this invention, an article carrier formed in a rectilinear arrangement comprises a frame structure, a plurality of struts depending downwardly from the frame structure to form at least two article receiving cells, a bottom element secured to the lower portions of the struts of each cell, a partition element disposed between two adjacent struts, the midportion of the partition element being transversely yieldable, at least one base strap disposed between the lower portions of two outer struts, and a promotional insert secured to the base strap and to a part of the frame structure and forming a part of a carrier wall.

BRIEF DESCRIPTION OF DRAWINGS

In the drawings

FIG. 6 is an isometric view of a carrier without a sleeve;

FIG. 7 is a side view of two carriers without sleeves and disposed in a stacked nested fashion;

BEST MODE FOR CARRYING OUT THE INVENTION

Figure 1:
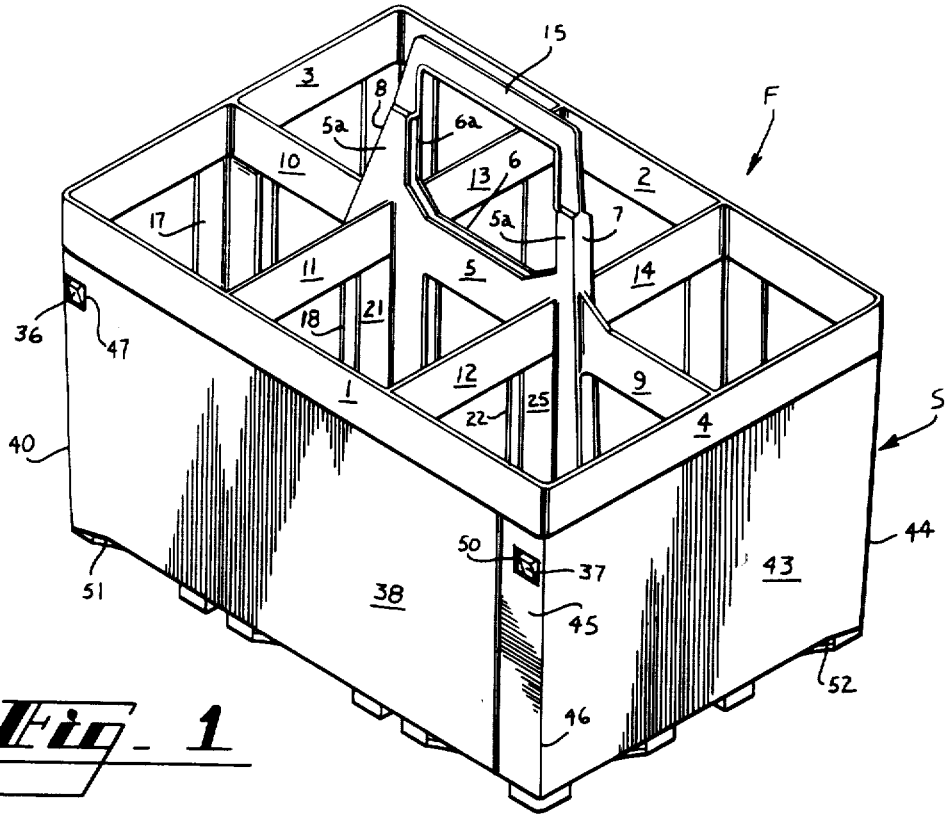
FIG. 1 is an isometric view of an article carrier constructed according to one form of this invention.

In the drawings the letter F generally designates the upper frame structure of the plastic portion of the carrier from which cell forming struts depend downwardly. More specifically the numerals 1 and 2 designate side strips of the carrier to the respective adjustment ends of which the ends of end strips 3 and 4 are integrally secured. Frame structure F also includes longitudinal partition structure in the form of spaced parallel longitudinal strips 5 and 6 which are medially disposed in the central portion of the carrier and integrally secured at corresponding ends thereof at junctions 7 and 8. Also at one end of longitudinal strips 5 and 6, the longitudinal partition structure includes longitudinal strip 9 which is integrally secured at one end thereof to junction 7 and at the other end thereof to the inner surface of the end strip 4. In like manner longitudinal strip 10 is integrally formed at one end thereof to junction 8 and at the other end thereof to the inner surface of end strip 3.

To complete the frame structure F, transverse partition structure is provided in the form of transverse strips 11, 12, 13 and 14. More specifically transverse strips 11 and 12 are each integrally secured at one end thereof to longitudinal strip 5 and at the other end thereof to the inner surface of side strip 1. In like manner, transverse strips 13 and 14 are each integrally secured at one end thereof to longitudinal strip 6 and at the other end thereof to the inner surface of side strip 2.

Carrying means for the article carrier is provided in the form of handle 15 which is integrally secured to the upstanding portions 5*a* and 6*a* of longitudinal strips 5 and 6 as best shown in FIGS. 1 and 6.

In order to form individual article receiving cells, a plurality of struts are provided on one side of the carrier as indicated by the numerals 16–27. For purposes of simplification, only one side of the carrier will be discussed in detail, it being understood that the other side of the carrier is similarly constructed. Each of the struts 16–27 comprises a left strip A and a right strip B which are integrally secured along adjacent edges at C. Also all of the struts 16–27 are integrally formed with frame structure F and extend downwardly therefrom. In order to complete the individual article receiving cells on one side of the carrier, bottom elements 28, 29, and 30 are provided. As best viewed in FIG. 6, each of the bottom elements 28, 29, and 30 is integrally formed with the lower portions of the associated struts of the respective article receiving cells.

Partition elements 31 and 32 are provided between adjacent cells disposed in the longitudinal direction of the carrier. More specifically partition element 31 is integrally secured along one edge to strip A of strut 18 and along the opposite edge to strip B of strut 19. Similarly partition element 32 is integrally secured along one edge to strip B of strut 25 and along the other edge to strip A of strut 24.

In addition partition elements 33, 34, and 35 are provided between adjacent article receiving cells disposed in the transverse direction of the carrier. Although not shown in detail, each of the partition elements 33, 34, and 35 is integrally secured to the associated struts in the same manner described above in connection with partition elements 31 and 32. Since the midportion of each partition element is offset vertically from the associated end portions, the midportions are transversely yieldable. This feature allows easy entry of the articles into the article receiving cells by guiding the articles in a downward direction while avoiding any collision between an article and a partition.

To complete the plastic portion of the carrier, notches 36 and 37 are formed on struts 16 and 27 respectively, it being understood that similar notches are formed on corresponding struts disposed on the opposite side of the carrier.

Therefore according to one aspect of this invention, a carrier is provided which is strong, reliable, durable and, at the same time, is constructed of a relatively small amount of plastic material and is produced from known die construction methods. In addition, as best shown in FIG. 6, each set of four struts associated with an article receiving cell is tapered downwardly and inwardly. Therefore each of the article receiving cells is spaced apart from an associated cell. This feature allows entry of the handle of an adjacent carrier into the medial area of a stacked upper carrier as best shown in FIG. 7. Of course this feature reduces transportation and storage costs associated with the carrier.

Figure 3:
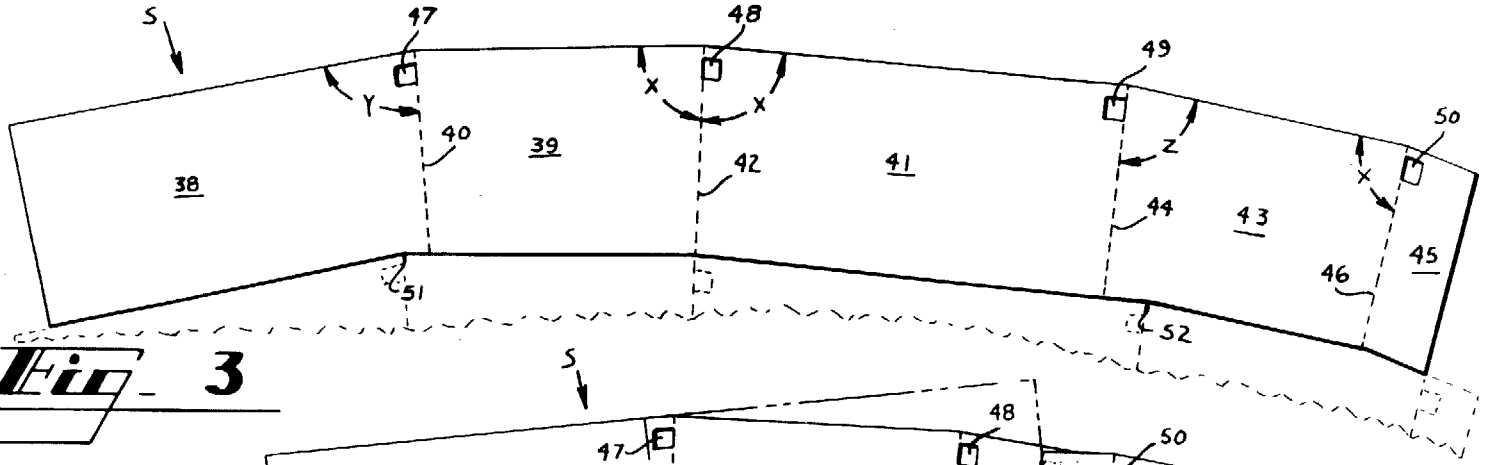
FIG. 3 is a plan view of a blank from which the sleeve of FIG. 2 is formed.

In order to provide carrier strength and visual appeal as well as added protection for the packaged articles, sleeve S, shown in blank form in FIG. 3, is provided. Specifically sleeve S comprises a side panel 38 to an end edge of which end panel 39 is foldably joined along fold line 40. Along the opposite edge of end panel 39, side panel 41 is foldably joined along fold line 42. In addition end panel 43 is foldably joined to an end edge of side panel 41 along fold line 44. To complete sleeve S, glue flap 45 is foldably joined to an end edge of end panel 43 along fold line 46. Also apertures 47, 48, 49, and 50 are formed in sleeve S as best shown in FIG. 3.

In order to facilitate nesting of adjacent sleeve blanks, cutaway portion 51 is formed on the lower edge of side panel 38 and, likewise, cutaway portion 52 is formed on the lower edge of end panel 43. Adjacent blanks can then be nested as shown by dotted lines in FIG. 3. Of course this feature provides economy of material in the production process of the sleeve.

Figure 4:
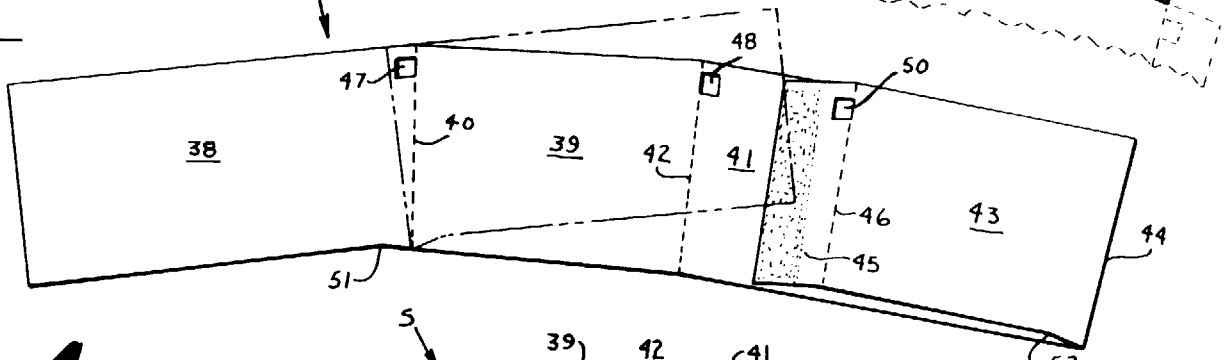
FIG. 4 shows an intermediate step through which the sleeve blank shown in FIG. 3 is manipulated to form a complete and collapsed sleeve as shown in FIG. 5.
Figure 5:
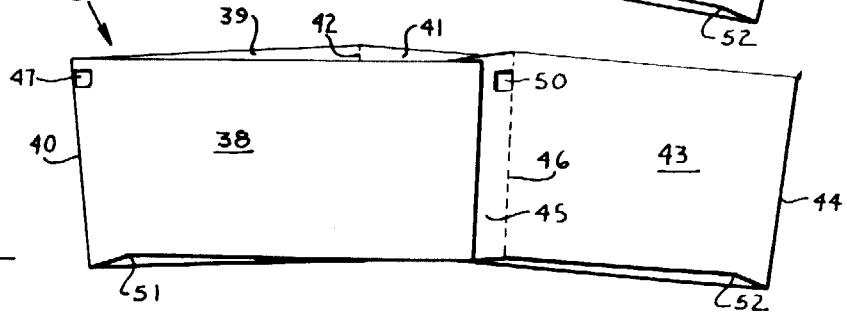

In order to form the sleeve from the blank shown in FIG. 3, initially it is necessary to fold end panel 43 and the associated glue flap 45 upwardly and over to the left along fold line 44. Then an application of glue is made to glue flap 45 as shown by stippling in FIG. 4. Following this operation, side panel 38 is elevated and folded over to the right along fold line 40. This causes the end of side panel 38 to become adhered to glue flap 45. The sleeve then appears as shown in FIG. 5 which represents the completed sleeve in collapsed condition.

Figure 2:
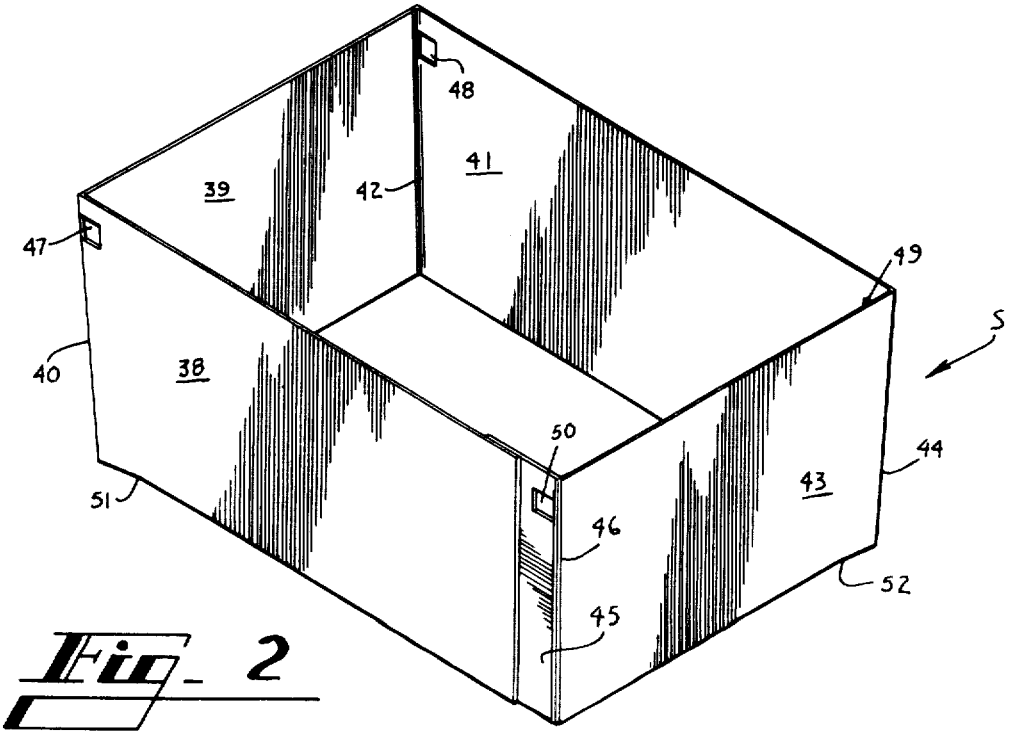
FIG. 2 is an isometric view of a carrier sleeve.

In order to erect the sleeve, side panels 38 and 41 are simply moved apart to positions perpendicular to end panels 39 and 43. The sleeve then appears as shown in FIG. 2. In order to form the completed carrier as shown in FIG. 1, it is simply necessary to insert the plastic portion of the carrier as shown in FIG. 6 into an erected sleeve as shown in FIG. 2. By this operation apertures 47, 48, 49, and 50 of sleeve S slide into an interlocked relationship with corresponding notches on the plastic portion of the carrier, such as notches 36 and 37 on the one side of the carrier. Since the outer struts of the carrier are tapered downwardly and inwardly and since the sleeve S is tapered in a corresponding fashion, the positioning of the plastic portion of the carrier into sleeve S is greatly facilitated.

Because sleeve S must conform to the tapered struts on the plastic portion of the carrier, each panel of the sleeve S must be angularly related with respect to the adjoining panel. Specifically angles X as shown in FIG. 3 are equal and each angle X corresponds to the angular disposition of the associated strut of the plastic portion of the carrier.

Ideally angle Y as shown in FIG. 3 should be equal to angles X. If this were the case, side panel 38 would occupy the position shown by the phantom lines in FIG. 4, following folding thereof along fold line 40. Of course this would cause an imprecise glued joint in the completed sleeve and the panels of the sleeve could not be in face contacting relation to each other when the sleeve is in collapsed condition, as shown in FIG. 5. According to one aspect of this invention, angle Y is lessened a small amount relative to angles X which in effect causes side panel 38 to adjust from a folded position such as shown by the phantom lines in FIG. 4 to the folded position shown in FIG. 5. To achieve proper symmetry in the completed sleeve, angle Z is also altered to a slight degree. Specifically the angular relationship between fold line 44 and the upper edge of end panel 43 is increased to cause end panel 43 to adjust proportionately upwardly to meet the end of bottom panel 38 following the folding of both panels. Since the side panels and the end panels are of different lengths, the ratio of the lessening of angle Y to the increase in angle Z is equal to the ratio of the length of side panel 38 to the length of end panel 43.

Although slightly different in degree, the angular dispositions between side panel 38 and end panel 39 as well as between side panel 41 and end panel 43 still conform generally to the angular disposition of the associated strut. Therefore by this aspect of the invention, a proper glue joint is provided, the dimensional integrity of the sleeve is not compromised, and the completed sleeve can lie flat as shown in FIG. 5.

A modified version of this invention is shown in FIGS. 8–11. The elements of the version of the invention shown in FIGS. 1–7 and which correspond to identical elements in the version shown in FIGS. 8–11 are identified by the same numerals for the sake of convenience.

According to this modification, base strap 53 extends between the lower portions of outer struts 16 and 19 and projects outwardly of the carrier by means of side tabs 54 and 55 which are integrally joined respectively to corresponding edges of struts 16 and 19. In similar fashion base strap 56 is integrally joined to outer struts 20 and 23 respectively by means of side tabs 57 and 58 and base strap 59 is integrally joined to outer struts 24 and 27 respectively by means of side tabs 60 and 61. Of course similar structure is disposed on the opposite side of the carrier. By virtue of the base straps, the strength of the carrier is greatly enhanced and a means is provided for receiving and temporarily securing promotional inserts as hereinafter described.

Figure 11:
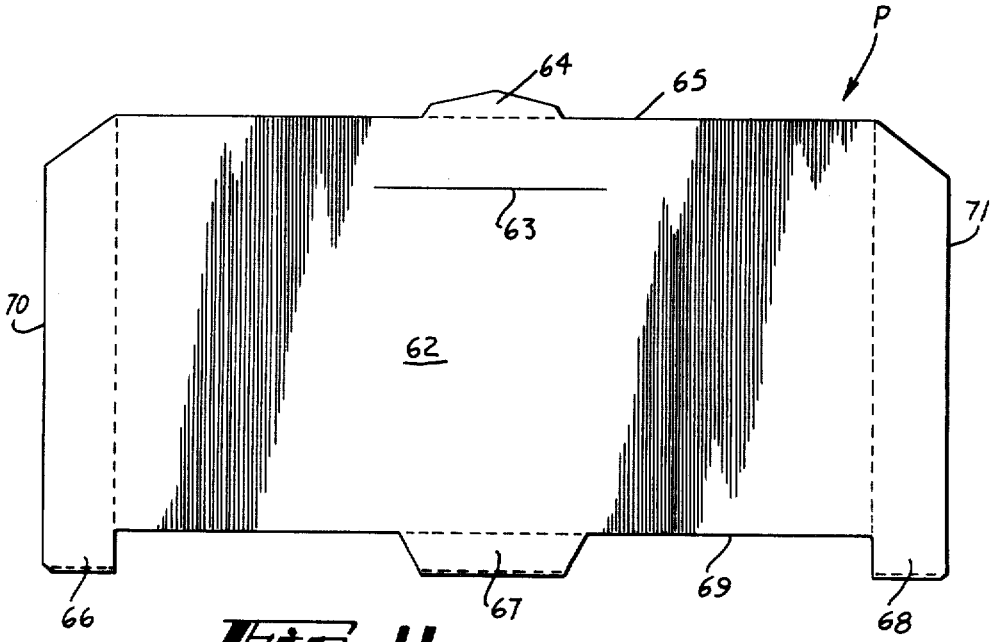
FIG. 11 is a plan view of the promotional insert.

As best shown in FIG. 11 the promotional insert formed according to this invention is identified generally by the letter P and includes base panel 62 and manipulation slot 63 formed therein. Additionally retaining tab 64 is integrally joined on the upper edge 65 of base panel 62. Similarly retaining tabs 66, 67 and 68 are integrally joined along the lower edge 69 of base panel 62. In order to facilitate placement of promotional insert P into the proper position relative to the carrier, side edges 70 and 71 diverge downwardly with respect to upper edge 65 of base panel 62.

Figure 8:
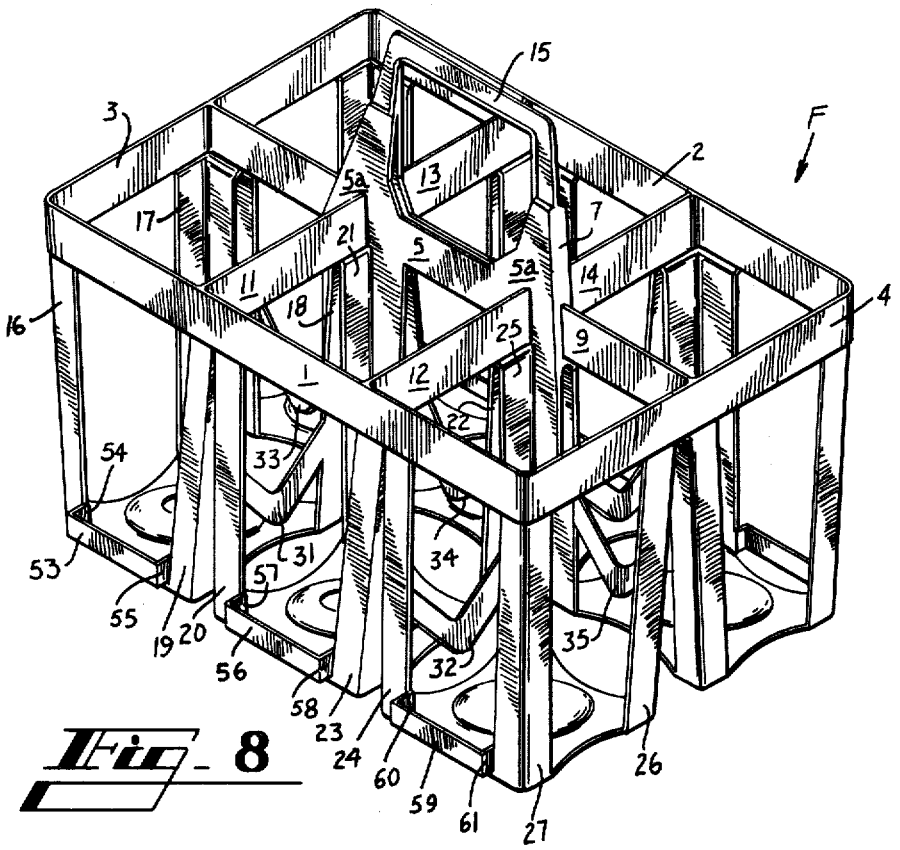
FIG. 8 is an isometric view of a modification of the carrier shown in FIG. 6.
Figure 9:
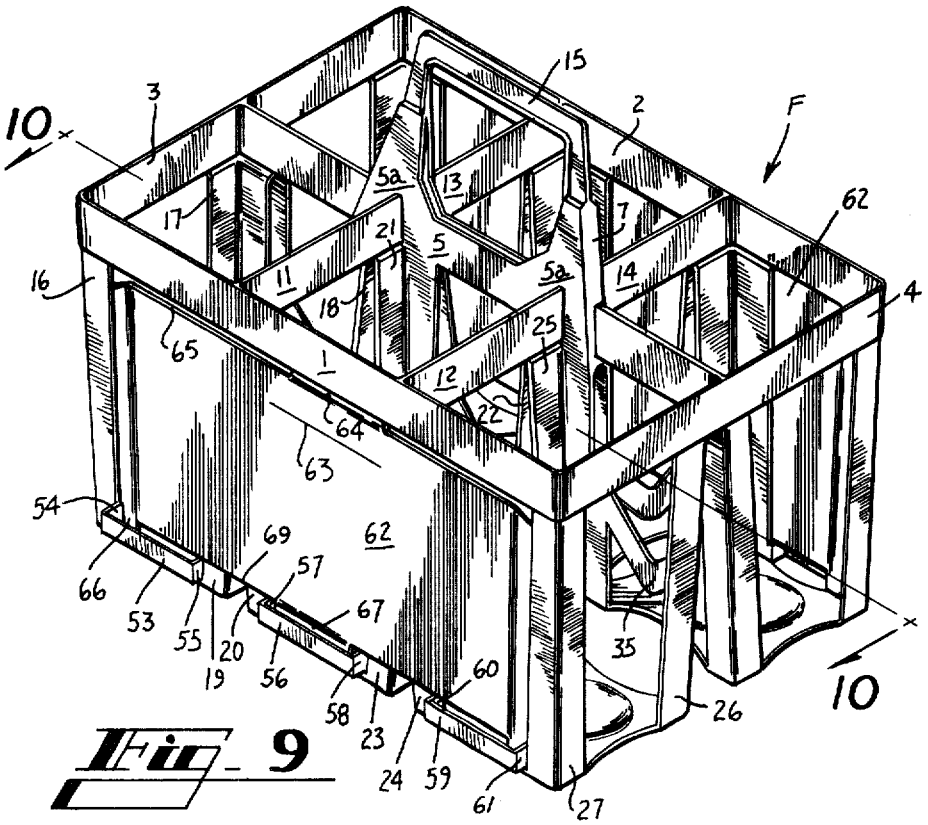
FIG. 9 is an isometric view of the carrier shown in FIG. 8 with a promotional insert associated therewith.
Figure 10:
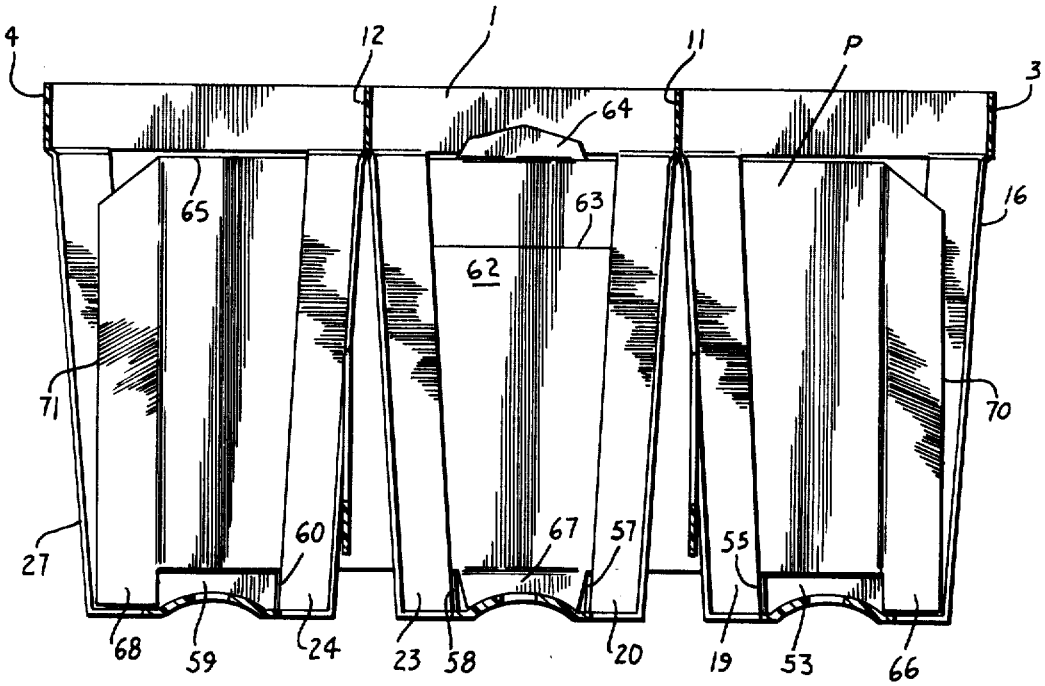
FIG. 10 is a sectional view taken along the line 10—10 in FIG. 9.

Therefore according to this form of the invention, the carrier can be utilized for the transport of a plurality of articles without the use of promotional insert P as shown in FIG. 8 or with promotional insert P as best shown in FIG. 9. In order to provide the carrier of FIG. 8 with an advertising capability, promotional insert P is initially placed along the side of the carrier and retaining tab 67 is positioned in ovelapping relationship with the inner surface of base strap 56. Generally simultaneously with this operation, promotional insert P is manipulated in such manner that side edges 70 and 71 of base panel 62 are moved into position behind struts 16 and 27 respectively. The lower portion of promotional insert P is prevented from slipping out of position by the cooperation between retaining tabs 66 and 68 and base straps 53 and 59 respectively as is apparent from FIG. 10. To complete the operation manipulation slot 63 allows retaining tab 64 to be easily bent over and slipped behind side strip 1 of frame structure F. Also since side edges 70 and 71 diverge downwardly, promotional insert P is easily maneuvered into position and without undue interference with the upper portions of struts 16 and 27 respectively. The same sequence of steps occurs on the opposite side of the carrier and, following which, the carrier appears as shown in FIG. 9.

INDUSTRIAL APPLICABILITY

Therefore by this invention an article carrier is provided which uses a relatively small amount of plastic material in conjunction with a carrier sleeve or insert to maximize carrier strength, article protection, overall carrier appearance and to provide for desired promotional means.

I claim:

1. An article carrier formed in a rectilinear arrangement and comprising a frame structure, a plurality of struts depending downwardly from said frame structure and arranged in at least two groups, a bottom element secured to the lower edges of each group of struts to form a pair of article receiving cells, a partition element disposed between and secured to two adjacent struts of one group of struts and forming a partition between said cells, the midportion of said partition element being transversely yieldable, a base strap interconnecting the lower portions of two adjacent struts of at least one group, said base strap projecting outwardly of said carrier with respect to said two adjacent struts, and a promotional insert being associated with one side of said carrier and including a retaining tab integrally joined to the lower edge of said insert and disposed in overlapping relationship with the inner surface of said base strap.

2. An article carrier according to claim 1 wherein said base strap is secured to two outer ones of said struts.

3. An article carrier according to claim 1 wherein said base strut is disposed parallel to the longitudinal axis of said carrier.

4. An article carrier according to claim 1 wherein said partition element is of an upright V-shaped configuration.

5. An article carrier according to claim 1 wherein a handle is secured to said frame and extends upwardly therefrom.

6. An article carrier according to claim 1 wherein each of said struts comprises a pair of strips secured along adjacent edges.

7. An article carrier according to claim 1 where a second retaining tab is joined to the upper edge of said insert and disposed in overlapping relationship with the inner surface of said frame structure.

* * * * *